US009053636B2

(12) United States Patent
Gordon

(10) Patent No.: US 9,053,636 B2
(45) Date of Patent: Jun. 9, 2015

(54) MANAGEMENT CENTER MODULE FOR ADVANCED LANE MANAGEMENT ASSIST FOR AUTOMATED VEHICLES AND CONVENTIONALLY DRIVEN VEHICLES

(71) Applicant: Robert Gordon, Plainview, NY (US)

(72) Inventor: Robert Gordon, Plainview, NY (US)

( * ) Notice: Subject to any disclaimer, the term of this patent is extended or adjusted under 35 U.S.C. 154(b) by 0 days.

(21) Appl. No.: 14/108,710

(22) Filed: Dec. 17, 2013

(65) Prior Publication Data

US 2014/0188376 A1 Jul. 3, 2014

Related U.S. Application Data

(60) Provisional application No. 61/747,331, filed on Dec. 30, 2012, provisional application No. 61/750,426, filed on Jan. 9, 2013, provisional application No. 61/827,067, filed on May 24, 2013.

(51) Int. Cl.

| | |
|---|---|
| ***G08G 1/09*** | (2006.01) |
| ***G08G 1/0967*** | (2006.01) |
| ***G08G 1/16*** | (2006.01) |

(52) U.S. Cl.

CPC ..... *G08G 1/09* (2013.01); *G08G 1/096775* (2013.01); *G08G 1/167* (2013.01)

(58) Field of Classification Search

CPC ..... G08G 1/096775; G08G 1/096716; G08G 1/0962; G08G 1/096725; G08G 1/0116; G08G 1/0141; G08G 1/09; G08G 1/167

USPC ..... 701/23, 24, 48, 117, 118, 119, 414, 701/484, 516, 540, 301

See application file for complete search history.

(56) References Cited

U.S. PATENT DOCUMENTS

| | | | | |
|---|---|---|---|---|
| 5,420,794 | A | 5/1995 | James | |
| 5,504,482 | A | 4/1996 | Schreder | |
| 5,689,252 | A | 11/1997 | Ayanoglu et al. | |
| 5,875,412 | A | 2/1999 | Sulich et al. | |
| 6,141,710 | A | 10/2000 | Miesterfeld | |
| 6,298,302 | B2 | 10/2001 | Walgers et al. | |
| 6,314,360 | B1 | 11/2001 | Becker | |
| 6,411,889 | B1 * | 6/2002 | Mizunuma et al. | 701/117 |
| 6,411,898 | B2 * | 6/2002 | Ishida et al. | 348/118 |
| 6,466,862 | B1 * | 10/2002 | DeKock et al. | 701/117 |
| 6,785,606 | B2 * | 8/2004 | DeKock et al. | 701/117 |
| 6,853,915 | B2 | 2/2005 | Hubschneider et al. | |
| 6,868,331 | B2 | 3/2005 | Hanebrink | |
| 6,873,908 | B2 | 3/2005 | Petzold et al. | |
| 7,092,815 | B2 * | 8/2006 | Dort | 701/117 |

(Continued)

OTHER PUBLICATIONS

Magellan Maestro 3100 User Manual, 2007, Magellan Navigation, Inc., 631459-01 A, Cover page, pp. iii, 1 and 30.*

(Continued)

*Primary Examiner* — Tuan C. To
*Assistant Examiner* — Dale W Hilgendorf
(74) *Attorney, Agent, or Firm* — Law Offices of Leo Mikityanskiy, P.C.; Leonid Mikityanskiy

(57) ABSTRACT

The automated lane management assist method, data structure and system receive unprocessed lane-specific limited-access highway information, including lane use and speed limits, from freeway transportation management centers or traffic management centers, process and convert the unprocessed information to a form that assists in the selection of driving lanes and target speeds for vehicles, and communicate the processed information to the vehicles by suitable means.

18 Claims, 9 Drawing Sheets

(56) References Cited

U.S. PATENT DOCUMENTS

| | | | | |
|---|---|---|---|---|
| 7,317,973 | B2 | 1/2008 | Dieterle | |
| 7,421,334 | B2 | 9/2008 | Dahlgren et al. | |
| 7,471,212 | B2 | 12/2008 | Krautter et al. | |
| 7,483,786 | B1 | 1/2009 | Sidoti et al. | |
| 7,590,489 | B2 | 9/2009 | Auger et al. | |
| 7,593,809 | B2 * | 9/2009 | Rosen et al. | 701/117 |
| 7,593,813 | B2 | 9/2009 | Hahlweg et al. | |
| 7,725,250 | B2 | 5/2010 | Bisdikian et al. | |
| 7,930,095 | B2 | 4/2011 | Lee | |
| 7,974,772 | B2 | 7/2011 | Nitz et al. | |
| 8,099,236 | B2 | 1/2012 | Olson et al. | |
| 8,103,435 | B2 | 1/2012 | Yang et al. | |
| 8,155,865 | B2 | 4/2012 | Bicego, Jr. | |
| 8,311,727 | B2 | 11/2012 | Eckstein et al. | |
| 8,326,474 | B2 | 12/2012 | Schrey et al. | |
| 8,332,132 | B2 | 12/2012 | Groenhuijzen et al. | |
| 8,346,430 | B2 | 1/2013 | Przymusinski et al. | |
| 2004/0246147 | A1 | 12/2004 | von Grabe | |
| 2004/0249562 | A1 | 12/2004 | Tsuge et al. | |
| 2005/0043880 | A1 * | 2/2005 | Yamane et al. | 701/200 |
| 2005/0131627 | A1 | 6/2005 | Ignatin | |
| 2005/0192033 | A1 | 9/2005 | Videtich | |
| 2006/0069496 | A1 | 3/2006 | Feldman et al. | |
| 2006/0247844 | A1 | 11/2006 | Wang et al. | |
| 2007/0050133 | A1 * | 3/2007 | Yoshikawa et al. | 701/301 |
| 2007/0208492 | A1 | 9/2007 | Downs et al. | |
| 2007/0213924 | A1 * | 9/2007 | Nagase et al. | 701/200 |
| 2008/0114530 | A1 * | 5/2008 | Petrisor et al. | 701/117 |
| 2009/0287401 | A1 | 11/2009 | Levine et al. | |
| 2010/0256898 | A1 | 10/2010 | Gassner | |
| 2012/0083995 | A1 | 4/2012 | Vorona | |
| 2013/0282264 | A1 * | 10/2013 | Bastiaensen et al. | 701/119 |

OTHER PUBLICATIONS

Brian Smith and Ramkumar Venkatanarayana, System Operations Data Integrity Assessment, University of Virginia Center for Transportation Studies Report No. UVACTS-14-5-129, Jun. 25, 2007.

Shawn Turner, Rich Margiotta and Tim Lomax, Monitoring Urban Freeways in 2003: Current Conditions and Trends from Archived Operations Data, Federal Highway Administration Report No. FHWA-HOP-05-018, Dec. 2004.

The University of Southern Queensland, Design Parameteres—Speed, available on the Internet at http://www.usq.edu.au/course/material/SVY2301/CIV2701/Lectures/Lectures%207-%20CIV2701-%20Design%20Factors%20-%20Speed.pdf.

Chuck Fuhs, Synthesis of Active Traffic Management Experiences in Europe and the United States, FHWA Report No. FHWA-HOP-10-031, May 2010.

Jerome M. Lutin, Alain L. Kornhauser, and Eva Lerner-Lam, "The Revolutionary Development of Self-Driving Vehicles and Implications for the Transportation Engineering Profession" ITE Journal, vol. 83 No. 7, Jul. 2013.

Robert Kelly and Mark Johnson, Legal Brief, Thinking Highways, North American Edition, Oct. 2012.

Donald A. Redelmeier and Robert J. Tibshirani, Are Those Other Drivers Really Going Faster?, Chance, vol. 13, No. 3, 2000.

* cited by examiner

Barrel and Zone Definitions

Barrel with Reversible Lanes

MANAGEMENT CENTER MODULE FOR ADVANCED LANE MANAGEMENT ASSIST FOR AUTOMATED VEHICLES AND CONVENTIONALLY DRIVEN VEHICLES

CROSS REFERENCE OF RELATED APPLICATIONS

This patent application is a nonprovisional application of, and claims priority to, provisional patent application Ser. No. 61/747,331 filed on Dec. 30, 2012, provisional patent application Ser. No. 61/750,426 filed on Jan. 9, 2013, and provisional patent application Ser. No. 61/827,067 filed on May 24, 2013, all of which are hereby incorporated by reference in their entirety.

FIELD OF THE INVENTION

This invention was not made pursuant to any federally-sponsored research and/or development.

The present invention relates to a method and system for assisting the drivers of vehicles, and the intelligent in-vehicle systems in partially or fully automated vehicles, to select a specific lane for vehicle travel on limited access highways, as well as a recommended vehicle speed.

BACKGROUND

Motorists driving conventional vehicles on freeways typically use visual information on their surroundings, together with whatever traffic related information that might be available, to select driving lanes and target speeds. In partially automated vehicles, this information may be enhanced by sensors located on the vehicle. Fully automated vehicles primarily use vehicle based sensor information to collect nearby status information and employ interpretative algorithms to convert this information to lane and speed choices.

In recent years, the increase in traffic levels along with difficulties with the construction of new freeway facilities has resulted in strategies that manage lane use. These strategies include the preferential assignment of classes of vehicles to specific lanes and the use of aggressive tolling strategies. In some cases, these strategies are lane specific and may vary with time-of-day or with traffic conditions.

An additional set of strategies (that may also be traffic responsive or that may vary with time of day) termed "active traffic management" also limit and control the use of lanes. These strategies have been employed in Europe for some time (see Fuhs, C., Synthesis of Active Traffic Management Experiences in Europe and the United States, FHWA Report No. FHWA-HOP-10-031, May, 2010) and are being increasingly emphasized by intelligent transportation systems in the U.S. Table 1 shows the strategies that constitute this set.

TABLE 1

| Active Traffic Management Strategies | |
|---|---|
| Speed Harmonization/ Lane Control | Utilizing regularly spaced, over lane speed and lane control signs to dynamically and automatically reducing speed limits in areas of congestion, construction work zones, accidents, or special events to maintain traffic flow and reduce the risk of collisions due to speed differentials at the end of the queue and throughout the congested area. |
| Queue Warning | Utilizing either side mount or over lane signs to warn motorists of downstream queues and direct through-traffic to alternate lanes - effectively utilizing available roadway capacity and reducing the likelihood of collisions related to queuing. |
| Hard Shoulder Running | Using the roadway shoulder (inside or outside) as a travel lane during congested periods to alleviate recurrent (bottleneck) congestion for all or a subset of users such as transit buses. Hard shoulder running can also be used to manage traffic and congestion immediately after an incident. |
| Junction Control | Using lane use control, variable traffic signs, and dynamic pavement markings to direct traffic to specific lanes (mainline or ramp) within an interchange area based on varying traffic demand, to effectively utilize available roadway capacity to reduce congestion. |
| Dynamic Re-routing | Changing major destination signing to account for downstream traffic conditions within a roadway network or system. |
| Lane Management (or Managed Lane) | Improving or facilitating traffic flow in response to changing roadway conditions. Lane management includes controlling use of lanes by vehicle eligibility (carpool or transit), access control, and price. |
| Variable Speed Limits | Dynamically changing speed limit signs to adjust to changing roadway conditions, oftentimes weather related. |
| Shoulder Use | Use of the shoulder by time of day for transit or HOV, and in some instances general purpose traffic, to provide improved mobility along or within congested corridors. |
| Pricing-based Management | Managing traffic demand and flow using priced lane facilities, where traffic flow in the priced lane(s) is continuously monitored and electronic tolls are varied based on real-time or near-real-time demand. Pricing of roadway facilities can collect a toll from all users of the facility. In the case of high occupancy toll (HOT) lanes, transit and carpools with a designated number of occupants are allowed to use the priced lanes for free or a reduced rate. |

Motorists are traditionally informed about lane selection associated with these strategies by dynamic message signs (DMS) also called variable message signs (VMS), by lane control signals (LCS) and by changeable speed limit signs controlled from a transportation management center (TMC). The driver uses this information, together with preferences that he/she may have and constraints imposed by the vehicle that he/she is driving, to select the appropriate lane and speed.

There have recently been significant developments in the development of automated vehicles. Levels of automation have been classified as follows by two agencies as shown in Table 2.

TABLE 2

| Levels of Automation | | |
|---|---|---|
| Automation Features | German Federal Highway Research Institute (BASt) | US - National Highway Traffic Safety Administration* |
| Driver only. | 1 | 0 |
| Driver assistance - The driver controls either longitudinal or lateral steering. The other task may be automated to a certain extent. | 2 | 1 |
| Partial Automation - The system takes over longitudinal and lateral control. The driver monitors the system and shall be prepared to take over control at any time. | 3 | 2 |
| High automation - The driver must no longer permanently monitor the system. In the event of a take-over request, the driver must take over control with a certain time buffer. | 4 | 3 |
| Full automation - In the case of a take-over request that is not followed, the system returns to the minimal risk condition. | 5 | 4 |

*Lutin, J. M, Kornhauser, A. L., and E. Lerner-Lam, "The Revolutionary Development of Self-Driving Vehicles and Implications for the Transportation Engineering Profession" ITE Journal, Vol. 83 No. 7, July, 2013.

The following discussion employs the U.S. classification system.

Automated vehicles at levels 2 through 4 generally provide two capabilities:

Navigation—The sequence of roadways to be utilized and turning directions to implement this sequence. These directions are recalculated so that failure to follow them will result in a new planned path.

Longitudinal and lateral control of the vehicle.

With the rapid improvement in implementing technology at Levels 2-4, the emphasis being placed on its implementation by auto manufacturers and others, the adoption of some form of authorization by three states (see Kelly, R. and M. Johnson, Legal Brief, Thinking Highways, North American Edition, October, 2012), it has been estimated that significant operational use may be achieved in ten to twelve years (see Self-Driving Cars: The Next Revolution, KPMG and the Center for Automotive Research).

At Levels 0 and 1, the functions of lane and speed selection are adequately performed by the driver. Research (Redelmeier, D. A. and R. J. Tibshirani, *Are Those Other Drivers Really Going Faster*?, Chance, Vol. 13, NO. 3, 2000) has shown, however, that drivers often incorrectly perceive that adjacent lanes are moving faster and are thus motivated to change lanes unproductively. This results in needless fuel consumption and a crash rate that is higher than otherwise would be the case. Guidance to the motorist on when a lane change would be appropriate will contribute to a smoother, safer ride with reduced fuel consumption. The Automated Lane Management Assist ("ALMA") concept disclosed in the present application provides this capability.

As the intent of levels 2 to 4 is to reduce, and ultimately eliminate the driver's real time participation in vehicle operation and management, a scheme to coordinate these decisions with the current limited access highway lane use and speed limit requirements as well as with the characteristics of the vehicle and the general preferences of the driver is required.

SUMMARY OF THE INVENTION

Conceptually, ALMA may be viewed as a level of decision software that lies between the vehicle's navigation function (position determination and route selection) and the lateral and longitudinal control functions as shown in FIG. 1.

FIG. 2 shows the principal data flow relationships among ALMA modules and the freeway traffic management center and the vehicle.

The ALMA concept converts information from freeway transportation management centers or Traffic Management Centers ("TMCs") operated by states and other agencies to a form that assists in the selection of driving lanes and selection of target speeds for vehicles. Although providing general road congestion information is well-known in the art, the use of specific lane status information on a multi-lane limited-access highway has not been used for assisting the driver or in an automated vehicle—for selecting a travel lane and the travel speed in that lane. In fact, the lane congestion or driving condition information on specific, short geographic roadway segments has not been used to assist the drivers, or the intelligent in-vehicle systems (in partially and fully automated vehicles), select the lane and the travel speed in that lane.

The ALMA Management Center (ALMAMC) obtains information on lane traffic conditions, lane use restrictions and speed limits from the TMCs, processes it to compute appropriate traffic parameters and reformats it to formats required by ALMA data structures. It also manages the static ALMA database. This information is communicated to the vehicle by a suitable means. Satellite radio and cellular telephone are examples of communication schemes. While ALMA can potentially use infrastructure-to-vehicle communications developed under the USDOT connected vehicle program, ALMA does not depend on the availability of communications that may be provided by that program.

The dashed rectangles enclosed by FIG. 2 represent components external to ALMA and the rectangles enclosed by solid lines are the components of the figure are ALMA components. The Guidance Assist Vehicle Module represented by the dash-dot line employs information developed by ALMA to provide lane selection and target speed information to the Vehicle Control system. The ALMA components include the following:

ALMA Management Center (ALMAMC)

This unit receives lane based traffic parameters and information on the state of the—traffic management controls from the Freeway Traffic Management Center and combines it with information in the ALMAMC portion of the ALMA Static Database. These ALMA Static Database elements are used to transform data developed by the Traffic Management Center to the ALMA data structures. This information is then transmitted to the Guidance Assist Vehicle Module. The ALMA Static Database structure itself is periodically updated and the updated structure transmitted to the Guidance Assist Vehicle Module. The ALMAMC may be physically implemented by a computer based center established for that purpose. Since the information required by the ALMAMC is largely generated by transportation management centers (TMCs), and since different TMCs have different software architectures and software structures, ALMAMC software will adapt to each TMC and will provide information to the Guidance Assist Vehicle Module (GAVM) using the ALMA data structure formats.

Static Database (SD)

These static database elements relate the link structure in the vehicle's map database to the ALMA Static Database structure.

Operator Data Entry (ODE)

The operator enters a limited amount of data about the vehicle (available toll tags, classification, height and weight under some circumstances) and about his willingness to pay tolls. Physically it may be a separate computer based unit, or alternatively the software may be incorporated into the vehicle's Navigation and Control System.

The Guidance Assist Vehicle Module (GAVM) employs the ALMA developed information to implement or assist in the implementation of mandatory and optional lane changes and the development of a target speed for the selected lane. The algorithms and logic for the GAVM are developed by the vehicle supplier (OEM) or other parties using ALMA provided data and ALMA data structures along with other data as shown In FIG. 2, and may depend on whether the vehicle is an automated vehicle or a conventionally driven vehicle.

FIG. 2 depicts the functional relationships among the modules. The physical relationships shown in the figure illustrate one interconnection and communications implementation. Other implementations are also possible. For example, the GAVM could be located in the ALMAMC (or in the "cloud") with wireless or cellular communications to the other vehicle modules. Alternatively, the ALMAMC module might be physically located in the vehicle with a cellular communication link between the Freeway Traffic Management Center and the ALMAMC.

It is an object of the present invention to achieve, provide, and facilitate:

The collection and processing of real-time or near-real-time data from traffic management centers (operated by agencies responsible for traffic control) on limited access highways as well as from other organizations.

The processing and conversion of these data into data that is useful for selection of lanes and target speeds for use by vehicles.

The processing and formatting of the data described above into a data structure that is appropriate for use by the vehicle.

The communication of the appropriately formatted data to vehicles in real time or near real time.

These and other strategies are accomplished by obtaining the real-time or near-real-time information from the TMCs and using that data to make or supplement vehicle lane control decisions, further enhancing the vehicle control process. The decisions and communication to the vehicles are done in real-time or near-real-time.

More specifically, the vehicle control will not only be determined based on direct external parameters such as those provided by the sensors on the vehicle and/or by vehicle-to-vehicle communications, but also by the data collected and processed by the TMCs from its own vehicle detectors, cameras, incident reports, scheduled roadway closures and TMC operator input. Additionally, the vehicle's operator may put in some information about the vehicle's characteristics, passenger occupancy and willingness to take highways, pay tolls, and other driving preferences.

The present invention differs from prior art references that provide lane selection and speed guidance in that the prior references are oriented towards conventionally-driven vehicles. The present invention is intended for use in conventionally driven vehicles, partially automated vehicles, and fully automated vehicles. As the level of automated driving increases, the need for greater precision in providing this guidance also increases because of reduced emphasis on driver input. These increases in precision include tighter geometric boundaries for which the information is provided as well as the increasing imposition of constraints on lane use inferred by traffic management authorities. The present invention includes the following features:

Collection of data from traffic management centers. The data includes, but is not limited to traffic detector information by lane, incident information, lane closure information, regulatory information, information on the real-time use of lanes and shoulders, real-time toll rate requirements for toll lanes and high occupancy toll lanes, and real time information on high occupancy vehicle lane use.

Processing of traffic detector information to enhance its accuracy and reliability for the purpose of developing lane guidance information and target speed recommendation for vehicles.

Definition of a sufficiently robust data structure (ALMA data structure) to physically decompose the limited access highway into components that provide for the precise presentation of lane use and target speed recommendations to the vehicle. The data structure includes physical roadway characteristics, regulatory requirements, and traffic flow characteristics.

Computation of a sufficiently broad spectrum of traffic condition variables that enable a wide variety of algorithms to be employed to provide lane selection and target speed guidance.

Transformation of the traffic condition variables and other traffic management center data into the ALMA data structure.

Functional architecture that implements the ALMA functions.

BRIEF DESCRIPTION OF THE DRAWINGS

These features, aspects and advantages of the novel Management Center Module For Advanced Lane Management Assist will become further understood with reference to the following description and accompanying drawings where.

DESCRIPTION

Introduction.

Active traffic management is an ITS technology that has found considerable use in Europe and is beginning to be used in the U.S. It brings traffic responsive control to the lane level by providing information to the motorist on the use lanes and speed limits associated with the lanes. These lane uses and speed limits uses may change as a function of time, traffic conditions or the location of incidents. The motorist is normally provided with this information by means of changeable message signs, lane use controls signals and variable speed limit signs.

In recent years, other lane management strategies including high occupancy vehicle lanes, high occupancy toll lanes and time variable toll pricing have become common, and variable speed limits are expected to become more commonly employed. While motorists driving conventional vehicles respond to this these requirements in a conventional way, the anticipated use of self driving vehicles or vehicles providing the driver with a considerable level of safety assists may require help in selecting the appropriate lane and adjusting the vehicle target speed to appropriate levels. This document terms such vehicles "automated vehicles" with the understanding that there may be varying levels of automation.

Advanced Lane Management Assist (ALMA) provides the vehicle with information that enables it to adapt to the requirements of the issues described above. It enables control information developed in freeway traffic management centers to be used together with information provided by the vehicle and vehicle operator. This information enables limited access highway lane control recommendations and appropriate speed settings to be provided to vehicles. The remainder of this document describes the concepts, components and software required to develop this information.

Basic Functions.

A system and method for Advanced Lane Management Assist (ALMA) are provided. ALMA provides information to conventional and automated vehicles to enable them to respond to information from the freeway traffic management center in a way that is similar or superior to the way that an unaided human driver would respond to the information.

In addition to lane based traffic parameters this information includes:

Lane closure commands;

Commands to move from a lane that is closed downstream of the lane control signal;

Speed limits by lane; and

Under some conditions, shoulders may be used as a travel lane.

Other constraints on lane use may apply. These may include:

Vehicle class. Lanes may be restricted for use by certain vehicle classes;

Vehicle overheight and overweight restrictions;

Availability of required vehicle occupancy;

Availability of toll tag;

Willingness of vehicle operator to pay toll; and

Access to exit ramp.

The Applicant, acting as his own lexicographer, identifies the symbols and abbreviations used in this application in Appendix A attached hereto and made a part hereof.

Figure 1:
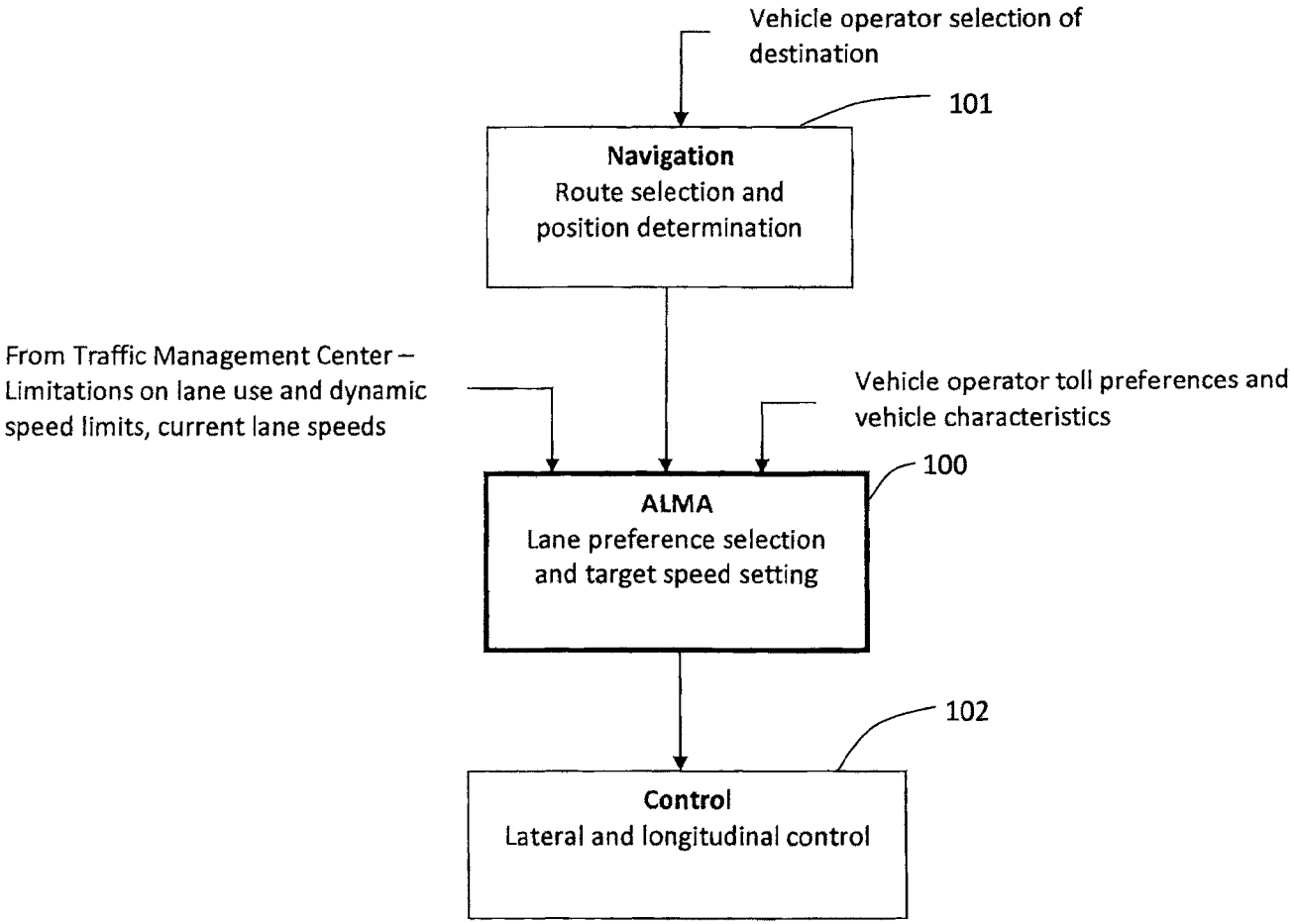
FIG. 1 is the representation of the relationship of lane preference and target speed selection to other automated vehicle functions.

Vehicles employing ALMA 100 require a route development capability (navigation system 101). Automated vehicles employing ALMA 100 have a system that uses vehicle based sensor information to control vehicle position and speed (vehicle control system 102. As shown in FIG. 1, ALMA 100 lies between these functions. It provides information to enable the vehicle or the driver to select appropriate lanes and provide target speeds.

Data Flow Relationships.

Figure 2:
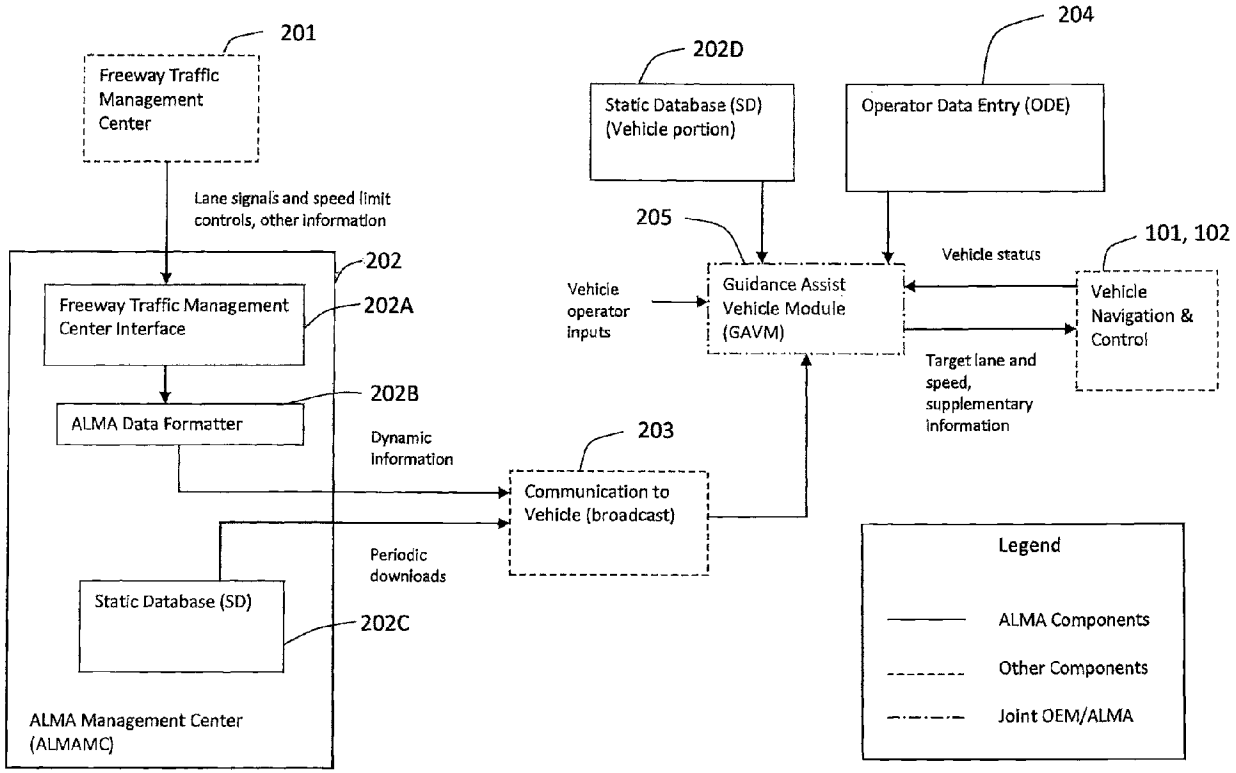
FIG. 2 is the block diagram representation of the ALMA Relationships.

FIG. 2 shows the principal data flow relationships among ALMA modules and the freeway traffic management center 201 and the vehicle. The functional architecture shown in FIG. 2 may be implemented by several physical architectures. FIG. 2 shows one possible implementation of a physical arrangement of these functional components, and the following description references this implementation.

The ALMA Management Center (ALMAMC) 202 obtains traffic parameters, lane use information and speed limits from Freeway Traffic Management Centers 201 and reformats it to formats required by ALMA data structures. It also manages the static ALMA database 202C, 202D. This information is communicated to the vehicle 203 by a suitable means. Satellite radio, conventional radio and cellular networks, including cellular telephone and data networks, are examples of communication schemes that may be used.

The dashed rectangles 201, 203, 206 enclosed by FIG. 2 represent components external to ALMA 100 and the rectangles 202,202A, 202B, 202C, 204 enclosed by solid lines are the components of the figure are ALMA 100 components. The ALMA components include the following:

ALMA Management Center (ALMAMC) 202

This unit receives information on the state of the traffic management controls from Freeway Traffic Management Centers 201 and combines it with information in the ALMAMC portion of the ALMA Static Database 202C. These ALMA Static Database elements assist in transforming data developed by the Traffic Management Center 201 to the ALMA data structures. This information is then transmitted 203 to the Guidance Assist Vehicle Module 205 The ALMA Static Database 202C, 202D structure itself is periodically updated and the updated structure transmitted to the ALMA Guidance Assist Vehicle Module 205. The ALMAMC 202 may be physically implemented by a computer based center established for that purpose. Since the information required by the ALMAMC 202 is largely generated by transportation management centers (TMCs) 201, and since different TMCs 201 have different software architectures and software structures, ALMAMC 202 software will adapt to each TMC 201 and will provide information to the Guidance Assist Vehicle Module (GAVM) in the formats described in Table 3 [051] and Tables 4 and 5 [052].

Static Database (SD) 202C, 202D

These static database 202C, 202D elements relate TMC based traffic parameters and other lane and roadway based information to the ALMA Static Database structure.

Operator Data Entry (ODE)

204 Any vehicle occupant, including the operator or driver, enters a limited amount of data about the vehicle (available toll tags, classification, height and weight under some circumstances) and his willingness to pay tolls. Physically, it may be a separate computer-based unit, or, alternatively, the software may be incorporated into the vehicle's Navigation 101 and Control 102 System.

The dash-dot enclosure in FIG. 2 represents the Guidance Assist Vehicle Module (GAVM) 205 that uses ALMAMC 202 information to identify a preferred lane and a target speed for that lane. The data set provided by the ALMAMC 202 includes those parameters that are likely to be required by vehicle-based algorithms that perform these functions.

Basic ALMA 100 Data Structure.

An earlier patent, U.S. Pat. No. 7,030,095 (Lee), provides lane status information with no discussion of its application. That patent however, provides the information aggregated at the traffic link level (a link is a roadway section between access and/or egress points on highway). That level of aggregation is not sufficiently detailed for use by automated vehicles. Furthermore the Lee patent does not provide for the additional features required to provide lane selection and speed guidance by automated vehicles or for more accurate guidance for conventional vehicles. The ALMA 100 data structure and the features described in this patent address these issues and provide guidance at the requisite level of detail and accuracy.

Figure 3:
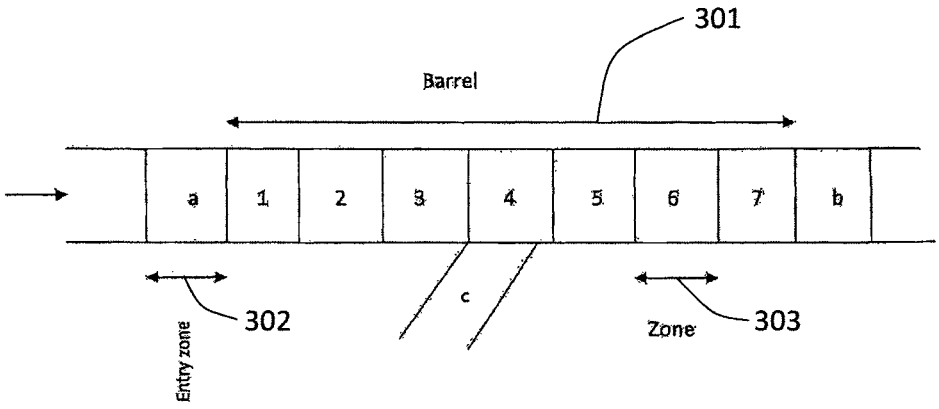
FIG. 3 is the representation of a Barrel and Zone Definitions.

In FIG. 3, a barrel 301 is a set of lanes in a roadway using lane management techniques. It is physically or functionally separated from other parallel lane sets. There are several types of barrels 301. The simplest type of barrel 301 has traffic flow in one direction; however, contra-flow lanes may be present. Barrel 301 boundaries are determined by changes in the physical roadway configuration and by permanent changes along the roadway in the regulatory use of the roadway or its lanes.

A barrel 301 is divided into zones 303. Zone 303 boundaries are determined by a number of factors including traffic conditions, placement of motorist information devices and regulatory devices that provide changeable information. The zone 303 boundaries are also identical to the active traffic management control signal boundaries.

Entry zones 302 are defined for locations adjacent to the barrel. A representation of a simple barrel 301 with its zones 303 is shown in FIG. 3. The sequence of zones downstream of an entry zone 302 (shown by the letters) is termed a path. The path may be represented as a set as follows $$ZP(P,\text{Barrel})=\{\text{Entry zone, number of zones in path, path trace less last zone, last zone}\}$$

Thus the path set for a vehicle entering at entry zone a is $$ZP(1,\text{Barrel})=\{a,7,1,2,3,4,5,6,7\} \quad (1)$$

The path set for a vehicle entering at c is $$ZP(2,\text{Barrel})=\{c,4,4,5,6,7\} \quad (2)$$

A path set for a vehicle in a contra-flow lane is $$ZP(3,\text{Barrel})=\{b,7,7,6,5,4,3,2,1\} \quad (3)$$

Note that the last zone 302 may also serve as an entry zone for another barrel. Depending on its destination requirements, a vehicle may exit a path prior to reaching the last zone on the path.

In some cases, an entry zone 302 may serve more than one barrel. This may happen when a roadway divides.

Figure 4:
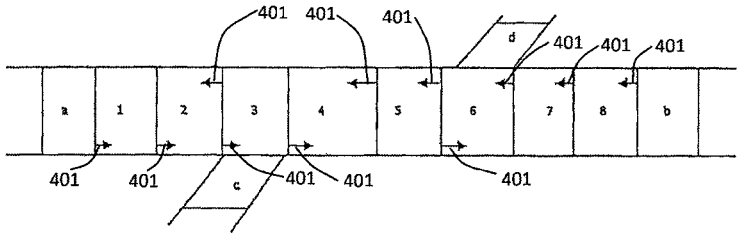
FIG. 4 is the representation of a Barrel with Reversible Lanes.

An example of a reversible lane barrel is shown in FIG. 4. The arrows 401 represent locations of active lane management devices such as lane control signals and speed limit signs. Path sets include the following:

$$ZP(1,\text{Barrel})=\{a,5,1,2,3,4,6,\} \quad (4)$$

$$ZP(2,\text{Barrel})=\{c,3,4,6,8\} \quad (5)$$

$$ZP(3,\text{Barrel})=\{b,6,8,7,6,5,4,2\} \quad (6)$$

$$ZP(4,\text{Barrel})=\{d,4,6,5,4,3\} \quad (7)$$

Vehicles may exit the barrel prior to the last zone identified in the path.

A relationship is required in the vehicle (and is assumed to be provided by the vehicle) between the vehicle's planned route as established by the vehicle mapping function in the navigation system 101). It must relate the segment sequence as mapped in the vehicle's mapping system to the system's appropriate barrel, path, entry zone and exit zone.

ALMAMC Top Level Module and Processes.

Figure 5:
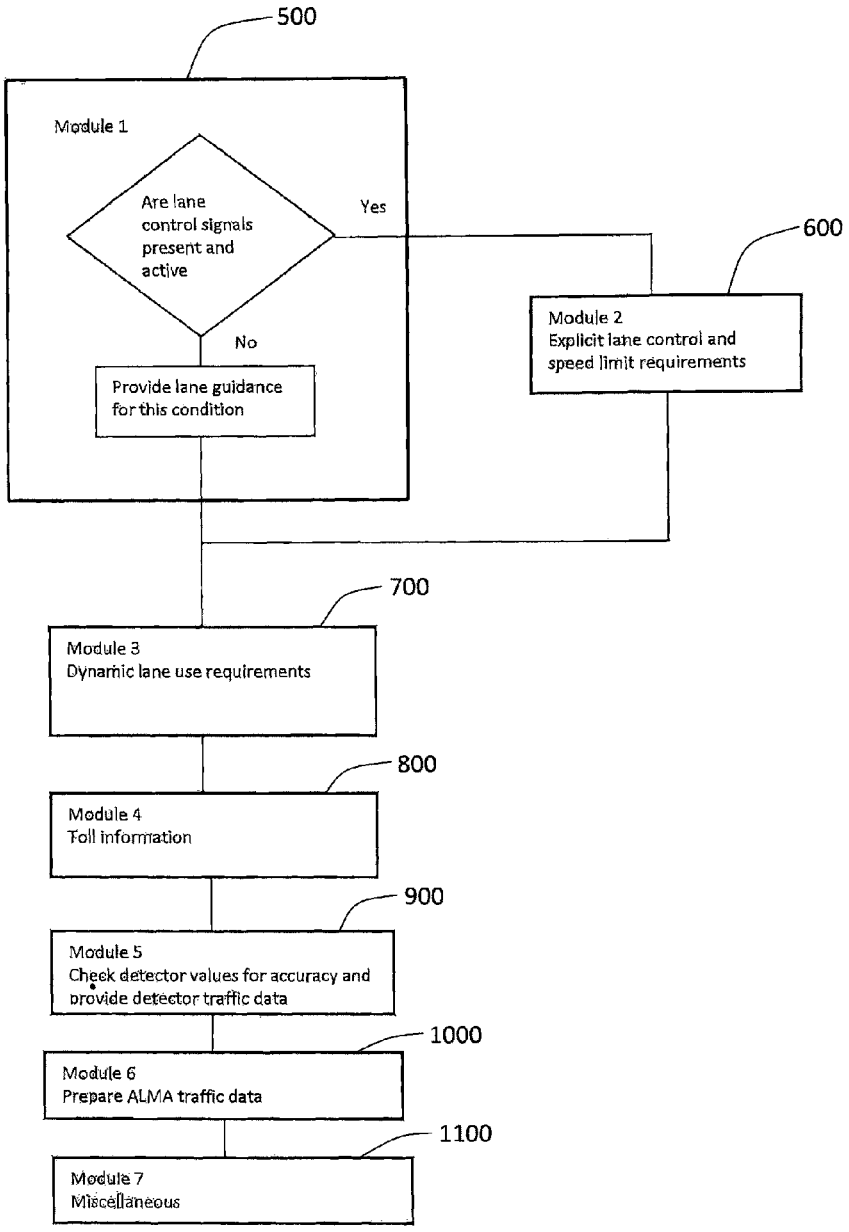
FIG. 5 is the ALMAMC Computational Sequence.

ALMAMC 202 executes its processes through software modules. With reference to FIG. 5, the ALMA Management Center 202 processes are computed in the following order:

Module 1 500—Lane Closure Guidance

Based on lanes that are closed this module provides lane selection guidance information. For single lane closures, it selects strategies from pre-established plans. For multiple incidents in close proximity, it provides guidance for an appropriate path.

Module 2 600—Explicit Lane and Speed Limits Requirements from TMC

Messages displayed on lane control signals (LCS) and variable speed limit signs (VSLS) are obtained from the TMC, converted to ALMA reference frame and provided to the vehicle. Similarly, information displayed on variable message signs (VMS) is obtained from the TMC 201, converted to ALMA reference frame and provided to the ALMA Guidance Assist Vehicle Module 205.

Module 3 700—Dynamic Lane Use Requirements

Where the use of lanes by vehicles is constrained by vehicle type or class or where a minimum number of persons in the vehicle is required for use of the lane, this information is provided to the ALMA Guidance Assist Vehicle Module 205.

Module 4 800—Toll Information

Toll information is provided to the vehicle so that appropriate lane guidance may be provided where mainline lane use is a function of the vehicle operator's desire to accept toll charges.

Module 5 900—Check Traffic Data for Accuracy

TMCs develop speed data with various levels of accuracy verification. Where appropriate this module provides lane data checks and identifies missing data.

Module 6 1000—Prepare ALMA Traffic Data for Use by Vehicle

Detector data is appropriately filtered and converted to the ALMA reference frame.

Module 7 1100—Miscellaneous Data

Data relating to incidents and closed highway sections is provided

ALMAMC Module Process Descriptions

Module 1500—Lane Closure Guidance

Figure 6:
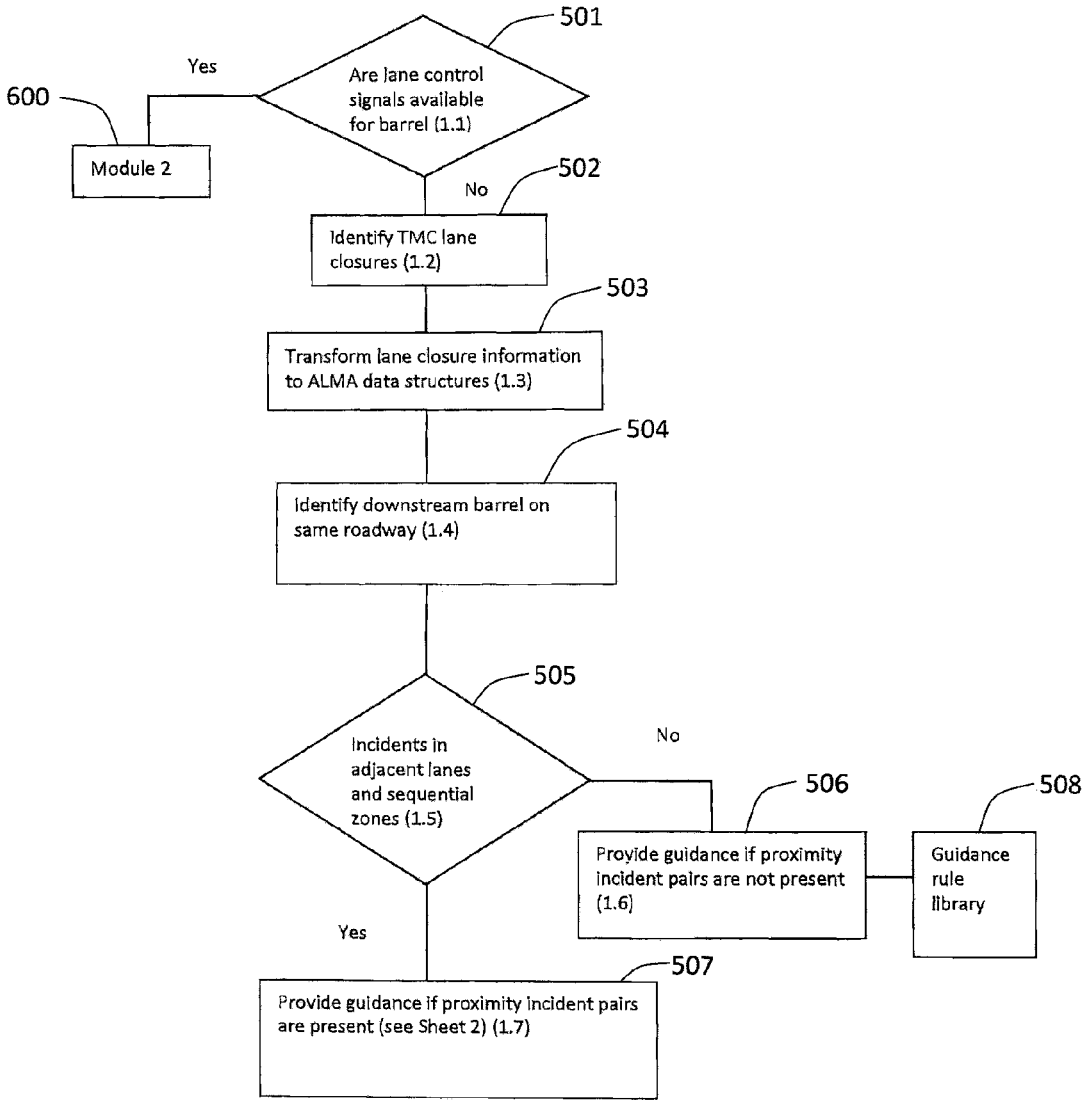
FIG. 6 is Sheet 1 of the ALMAMC Module 1 Flow Chart.
Figure 7:
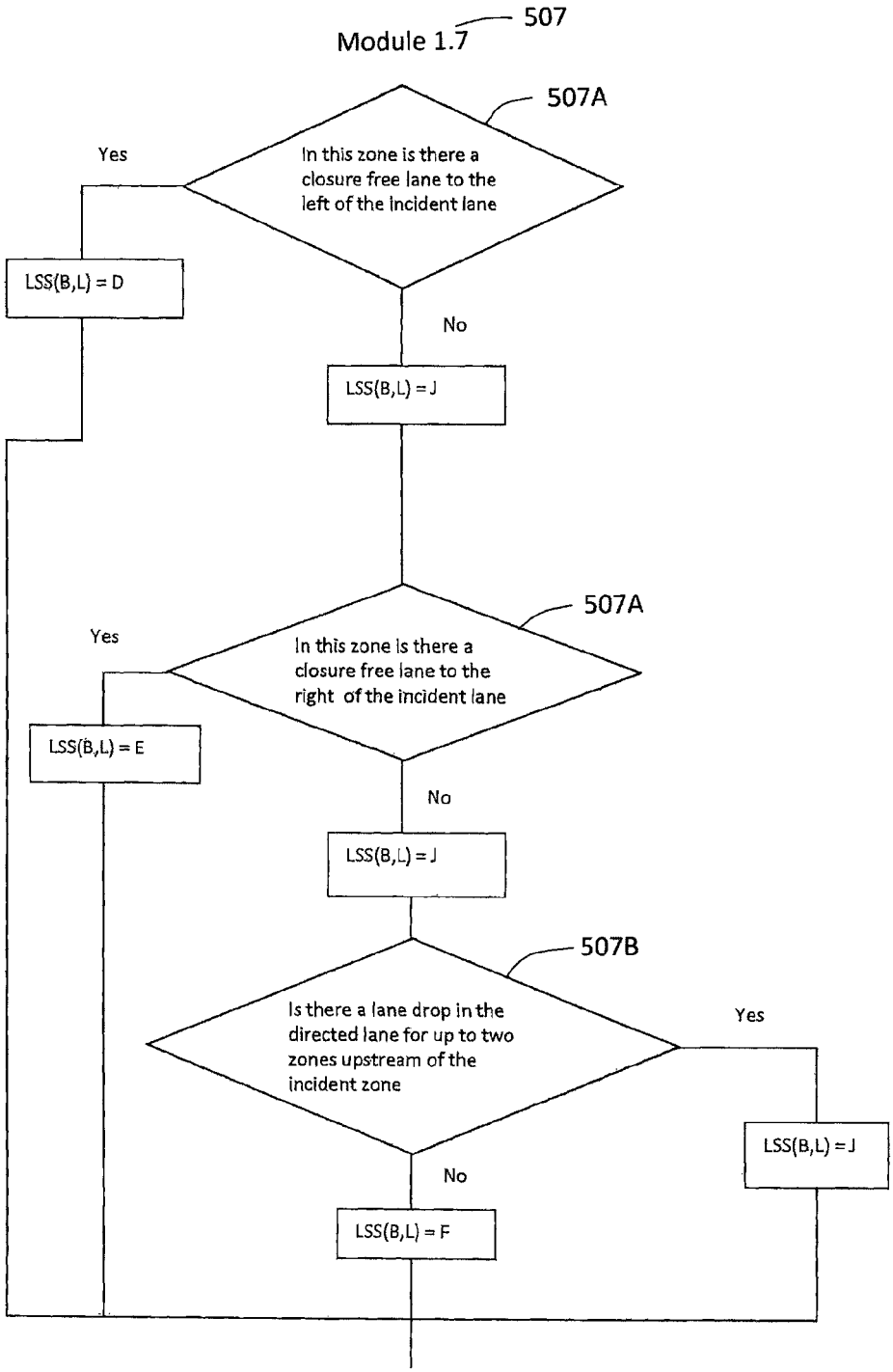
FIG. 7 is Sheet 2 of the ALMAMC Module 1 Flow Chart.

The flow chart for this module is shown in FIGS. 6 and 7. The following describes the module functions.

1.1 501 Identify Need for Module

If lane control signals are available and active for this barrel (LCSAVTMC(B)=1) go to Module 2, If not, perform the following processes.

1.2 502 Identify TMC 201 Lane Closures

Search the TMC 201 incident management database for lane closures currently in effect. In most cases this data should be available from database files. In some cases, the TMC 201 may need to prepare a separate file of this information. The information should include lane closures due to incidents, construction and weather. Closed entry and exit ramps are provided. This module provides a portion of the interface with the TMC 201.

Input: TMC incident, construction and weather database files

Output: Lane closure position and lanes closed in TMC position coordinates (roadway, links, mileposts, latitude, longitude). This constitutes set {TMCLC(PO,L)} where PO denotes the lane closure position in TMC 201 nomenclature.

1.3 503 Transform Incident Information to ALMA Data Structure

The incident information from the TMC may be in various forms such as milepost, TMC link or latitude and longitude. Module 1.2 502 transforms it to ALMA barrel, zone and lane designations.

Input: Incident location and lanes closed in TMC position coordinates

Output: Sets of barrels, zones, lanes closed—{INC(B,Z, {Lanes closed}}

Sets of barrels, exits closed—{EXC(B,Z)}

1.4 504 Identify Downstream Barrels on Same Roadway

The static database 202C, 202D contains a file that enables the identification of the downstream barrel on the same roadway (DBS). This module is, in essence, a component of the static database 202C, 202D.

Output: R{DBS(NM,DIR,FB,LB)}

1.5 505 Adjacent Lane Sequential Zone Test

If incidents in both adjacent lanes and in sequential zones occur, they are termed a proximity pair. The test for a proximity pair will be made for the barrel with the upstream incident and for the barrel with the downstream incidents. When this condition is not satisfied, Module 1.6 506 is employed.

When the condition is satisfied, Module 1.7 507 is used.

Output: {SZP(CB,CZ,DB,DZ)}

1.6 506 Implement Lane Guidance Plan for Each Barrel where a Proximity Pairs is not Present This module develops a lane guidance plan for each barrel when the condition in Module 1.5 is not satisfied. If the closures actually take place in different zones, at least one unblocked lane is available for diversion. A library 508 consisting of a general set of rules for lane guidance will be referenced. These rules will provide guidance in LSS format for roadways of 1 through 6 lanes for each combination of lane closure possibilities due to a single incident. Guidance will be provided on a barrel 301, zone 303 and lane basis. It will include the following information:

A—Movement in this lane permitted

D—Move to left

E—Move to right

F—Lane closed

J—No guidance provided

Movement information is provided for closed lanes in the zone 303 with the incident as well as two zones 303 upstream of the zone 303 containing the incident. If one or more of the upstream zones 303 lies in another barrel 301 on the same roadway, zone guidance for the incident will be provided for the upstream barrel. Guidance plans will also consider the situation where the downstream barrel (the barrel actually containing the lane blockage incident) also contains a lane drop.

1.7 507 Implement Lane Guidance Plan for Each Barrel where Proximity Pairs are Present The flow chart for this module is shown in FIG. 7. The computation processes for each qualifying incident provide the first control at two zones upstream of the first lane blocking incident (of each pair) that meets the criterion in Module 1.4 504.

The module considers the case where two lane blocking incidents occur in adjacent lanes 507A and in sequential zones 507B. The processes in the flow chart provide for diversion to an unblocked lane where it is possible to do so and otherwise indicate that guidance cannot be provided.

Module 2 600—Ex Licit Lane and Speed Limit Requirements from TMC 201

Figure 8:
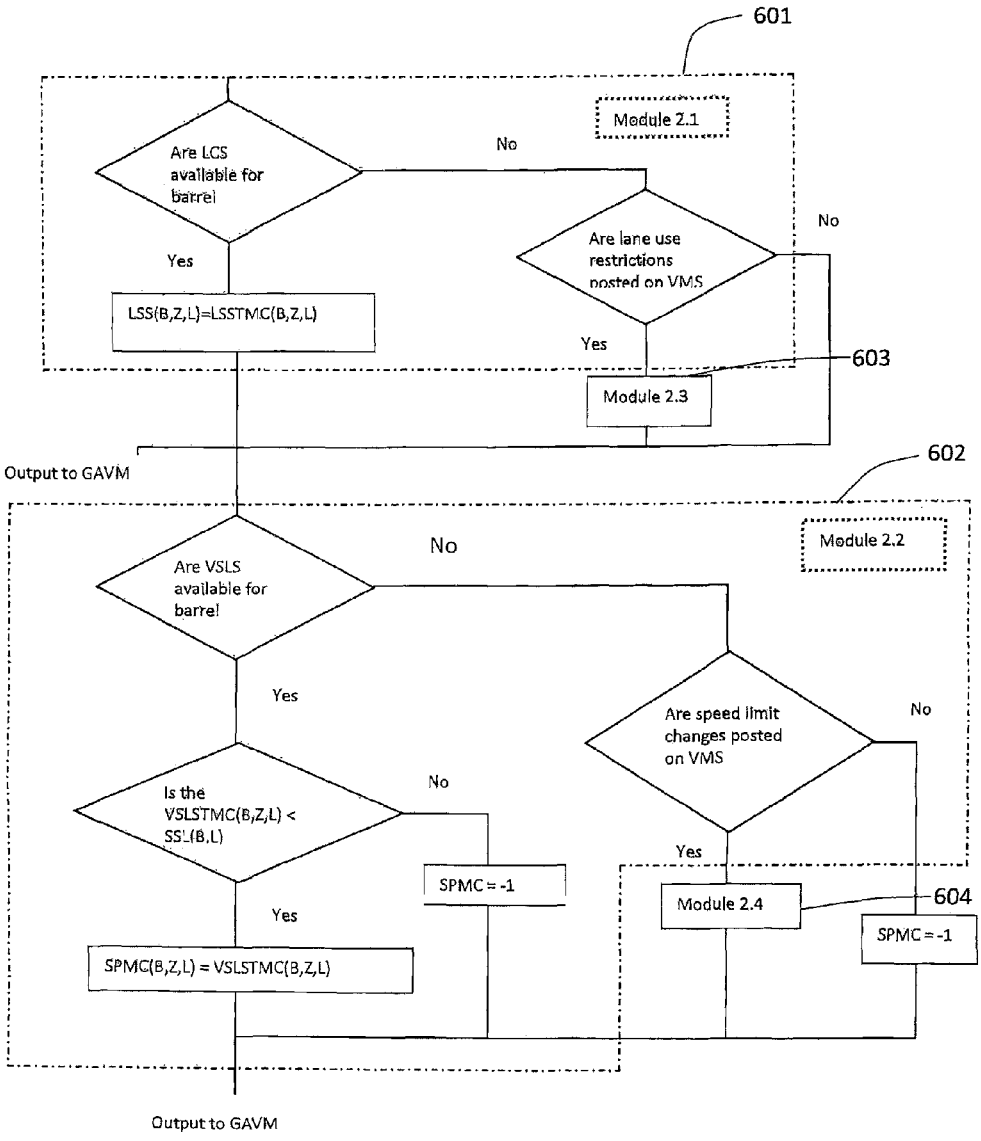
FIG. 8 is the ALMAMC Module 2 Flow Chart.

Some TMCs 201 provide explicit lane control and speed limit requirements. When appropriate, this module obtains this information from the TMC 201 and provides it to the vehicle. These may be developed in the TMC 201 by some combination of automatic and manual operation. The Module 2 Flow Chart (FIG. 8) provides the relationships.

2.1 601 Convert Lane Control Information from TMC LCS to ALMA Protocols

For agencies that provide this information, LCS information will be obtained from the TMC 201. Shoulder use information may be included. When LCS are employed, the ALMA zones 303 should be coincident with the location of these devices. If lane control information is provided by variable message signs (VMS), control is transferred to Module 2.3 603.

Output to ALMAVM: LSS(B,L,Z)

Notice of automatic speed enforcement AUTOENF in the barrel 301 will also be sent to the vehicle via the static database.

2.2 602 Convert Speed Limit Information from TMC VSLS to ALMA Protocols

For agencies that provide this information, VSLS information will be obtained from the TMC. Shoulder use information may be included. When VSLS are employed the ALMA zones 303 are often coincident with the location of these devices. If the currently displayed speed limit is equal to the normal or static speed limit, no special speed reduction requirement is assumed to be present. This condition is transferred to the vehicle. If speed limit information is provided by variable message signs (VMS), control is transferred to Module 2.4 604.

Output: SPMC(B,Z,L)

2.3 603 Convert Lane Control Information Provided on Dynamic Message Signs (DMS) to ALMA Protocols In some cases lane control information is provided on DMS. While this may reflect incident conditions it may also result from weather or construction. Most TMCs 201 use a message with a structured syntax to provide this information. This module will search the TMC DMS message file for this structure, extract the lane control information, and convert the applicable location range from TMC coordinates to the ALMA zone structure 201, 202, 203. Alternatively, the TMC 201 will provide this information to the ALMAMC 202 by means of a special message.

Output: LSS(B,Z,L)

2.4 604 Convert Speed Limit Information Provided on Dynamic Message Signs DMS to ALMA Protocols In some cases speed control information is provided on DMS. While this may reflect incident conditions it may also result from weather or construction. Most TMCs 201 use a message with a structured syntax to provide this information. This module will search the TMC DMS message file for this structure, extract the speed information, and convert the applicable location range from TMC coordinates to the ALMA zone structure 301, 302, 303. Alternatively, the TMC 201 will provide this information to the GAVM 205 by means of a special message.

Output: SPMC(B,Z,L)

Module 3 700—Dynamic Lane Use Requirements 3.1 Vehicle Type

In most cases, the lane use requirements as a function of vehicle type (passenger cars, buses, trucks) do not vary with time. This information is incorporated into the ALMA static database 202C, 202D as LVR(B,L). In some cases, demand management techniques vary lane use as a function of time of day or in response to traffic conditions. Where this is the case, motorists are notified of the modified requirements by means of DMS or by special changeable message signs provided for this purpose. In cases where dynamic lane use requirements are employed, it is expected that the TMC 201 will provide a message with modified LVR(TMC coordinates, L).

Output: LVR 3.2 Number of Occupants

In most cases, the requirements for entry into a HOV lane do not vary with time. This information is incorporated into the ALMA static database 202C, 202D as ON(B,L). In some cases, demand management techniques vary this number in response to traffic conditions. Where this is the case, motorists are notified of the modified requirements by means of DMS or by special changeable message signs provided for this purpose. In cases where dynamic lane use requirements are employed, it is expected that the TMC 201 will provide a message with modified ONTMC requirements for transmission to ALMAMC 202. The ALMAMC 202 will, in turn, convert this information to a set of applicable requirements {ON(B,L)}.

Output: {ON(B,L)}

Module 4 800—Toll Information

The purpose of this module is to provide toll information to the vehicle operator through the GAVM 205 and thence to the ODE 204.

The basic parameter developed by the module is {VTR(B1, Z1,B2,Z2)}. It represents the set of toll charges from the vehicle's entry point in the toll system (Barrel B1, Zone Z1) to the point at which it exits the toll system (Barrel B2, Zone Z2). A set of baseline tolls is provided in the static database 202C, 202D. If these tolls vary with time or traffic conditions, this information will be provided to the ALMAMC 202 by the TMC 201. These updates are then sent to the GAVM 205.

Output: {VTR(B1,Z1,B2,Z2)}

Module 5 900—Check Detector Data for Accuracy

Data for each lane is developed from detector speed, volume, occupancy and classification volumes. This data will originate with point traffic detectors in Freeway Management Systems (FMS).

Figure 9:
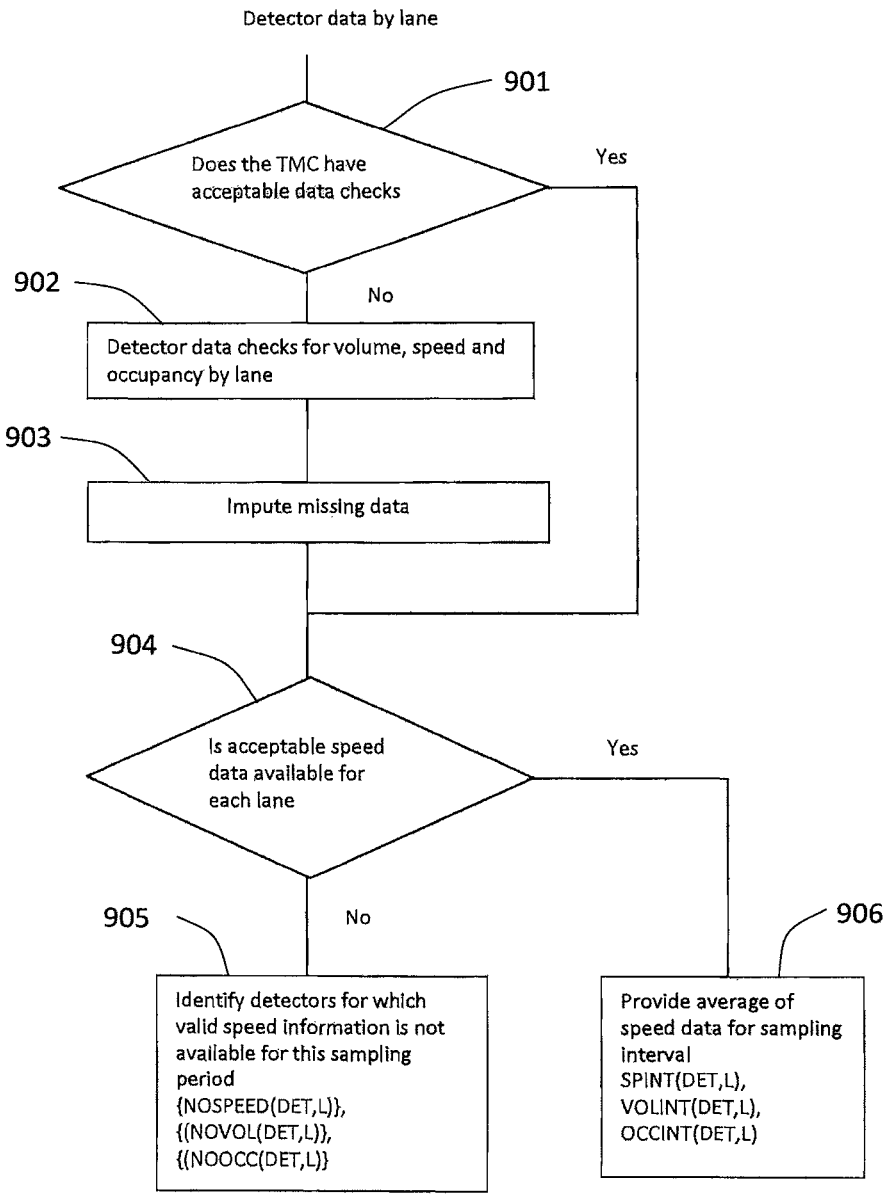
FIG. 9 is the ALMAMC Module 5 Flow Chart.

FIG. 9 shows the flow chart for Module 5 900. Most TMCs 201 provide point detector data in intervals of data averages ranging from ten seconds to thirty seconds on a per lane basis. Detector data may experience random errors, inconsistencies or be unavailable for short periods. Most TMCs 201 provide data checks for these issues and, if necessary, impute missing data by reconstructing it from available data. As shown in the flow chart, the requirement to check the data 901 is by-passed for TMCs 201 that provide this capability. The remaining steps in the module develop {NOSPEED(DET,L)}, {NOVOL(DET,L)}, and {NOOCC(DET,L)} 905 set of barrels and zones for which detector data is unavailable for this interval.

Acceptable speed data 904 is averaged over the sampling interval 906 Where the TMC 201 does not provide sufficient data checking and imputation capability, the alternative path in FIG. 9 provides for these steps. Where data checks are required, this capability is provided 902. Missing data will be imputed 903. Examples of processes for accomplishing this are described in Smith (Smith, B. and R. Venkatanarayana, *System Operations Data Integrity Assessment*, University of Virginia Center for Transportation Studies Report Number UVACTS-14-5-129, Jun. 25, 2007)—and Turner (Turner, S., R. Margiotta and T. Lomax, *Monitoring Urban Freeways in* 2003*: Current Conditions and Trends from Archived Operations Data*, Federal Highway Administration Report No. FHWA-HOP-05-018, December, 2004). These processes generally require volume and lane occupancy data in addition to the speed data in order to employ volume, speed and occupancy relationships in the checking process.

Module 6—Prepare ALMA Data 1000

This module uses the speed, volume, occupancy and vehicle length classification data from point traffic detectors in each lane to develop the following zone parameters for communication to the Guidance Assist Vehicle Module (GAVM) 205: zone speed, zone density, zone volume, zone passenger car equivalents, zone average headway, average vehicle length for zone.

This module performs two functions:

6.1 Filter Detector Data

A Kalman filter will be used to process the SPINT(DET,L) valid speed data (valid if SPINT(DET,L)< >−1), OCCINT valid occupancy data (valid if OCCINT< >−1, VOLINT valid volume data (valid if VOLINT< >−1) to conform to a common data period such as one minute. If it is not valid, data from the prior minute will be used as the Kalman filter input. Standard Kalman filter equations will be used (see, for example Welch, G and T R Bishop, "An Introduction to the Kalman Filter", University of North Carolina Department of Computer Science, TR 95-041, 2006). Filtered parameters include speed (SPFIL(DET,L)), filtered volume (VOLFIL (DET,L)), filtered occupancy (OCCFIL(DET,L)). If the standard deviation of the error estimate provided by the Kalman filter exceeds settings established by the ALMAMC operator, an indication (NOSPEED(DET,L), (NOOCC(DET,L), NOVOL(DET,L) will be provided for that data period. The Kalman filter's standard deviation for speed (SPDEV(DET, L) will also be provided.

Filtering techniques other than a Kalman filter may also be used. Examples of other filtering techniques include a first-order low-pass filter and a moving average.

6.2 Data Conversion Relationships 6.2.1 Space Mean Speed and Density

Speed data collected from or computed from point detector data is time mean speed. It is more appropriate to use space mean speed for ALMA's purposes. The definition of these quantities and the relationship between them is provided by May (May, A. D., "Traffic Flow Fundamentals", Prentice Hall, 1990). The relationship when solved for space mean speed, and using the Kalman filters error estimate is shown as follows:

$$SPSP(Det, L) = \frac{SPFIL(Det, L) + \sqrt{(SPFIL^2(Det, L) - 4 * (SPDEV^2(Det, L)}}{2} \quad (8)$$

The relationship between density and the volume and space mean speed variables is (May, op.cit.)

$$DENFIL(Det, L) = \frac{VOLFIL(Det, L)}{SPSP(DET, L)} \quad (9)$$

6.2.2 Compensated Occupancy

Gordon (Gordon, R L and Tighe, W, "Traffic Control Systems Handbook", FHWA Report FHWA-HOP-06-006) defines occupancy as follows:

$$\theta = \frac{100}{T * LR} \sum_{i=1}^{N} (t_i - D) \quad (10)$$

Where:

θ=Raw occupancy, in percent

T=Specified time period, in seconds $t_i$=Measured detector pulse presence, in seconds LR=Ratio of the effective length of the vehicle plus the loop to the vehicle length N=Number of vehicles detected in the time period, T D=Detector drop out time—detector pick up time While this definition was developed for inductive loop detectors, other detector technologies exhibit similar detection zones, but with different values for L.

The occupancy value provided by most TMCs 201 do not provide compensation for this effect. Where this is the case, the occupancy data will be compensated for LR. This will permit the use of a mix of detection technologies from different TMCs 201 as well as the use of detectors using different technologies in a single TMC 201. The relationships for compensated occupancy (COMPFILOCC) are:

For each detector station and lane, $$OCCINT(Det,L)=\theta \quad (11)$$

OCCFIL(Det,L) is the corresponding Kalman filtered occupancy variable

If the data is already compensated by the TMC then $$COMPFILOCC(Det,L)=OCCFIL(Det,L) \quad (12)$$

If the data has not been compensated by the TMC then $$COMPFILOCC(Det,L)=OCCFIL(Det,L)/LR \quad (13)$$

6.2.3 Vehicle Class Fractions, Passenger Car Equivalents (PCE) and Average Vehicle Length Some algorithms in the Guidance Assist Vehicle Module 205 may elect to use a comparison of PCEs in adjacent lanes as a parameter for lane selection. Equivalency factors are identified for trucks and buses ($E_T$) and for recreational vehicles ($E_R$) in the Highway Capacity Manual ("HCM 2010", Transportation Research Board, 2010). HCM 2010 provides these factors as a function of highway grade and the percentage of vehicles in each class.

For each data accumulation period (typically one minute) certain detectors provide a count of vehicles in each class. These are denoted as VAUTO(Det,L,p), VTRUCK(Det,L,p), VRV(Det,L,p). p is the data accumulation period.

Hourly compilations of these values are compiled and fractional values for each class are computed as follows:

$$FRAUTO(Det, L, Hr) = \frac{\sum_p VAUTO(Det, L, p)}{\sum_p VAUTO(Det, L, p) + VTRUCK(Det, L, p) + VRV(Det, L, p)} \quad (14)$$

$$FRTRUCK(Det, L, Hr) = \frac{\sum_p VTRUCK(Det, L, p)}{\sum_p VAUTO(Det, L, p) + VTRUCK(Det, L, p) + VRV(Det, L, p)} \quad (15)$$

$$FRVRV(Det, L, Hr) = \frac{\sum_p VRV(Det, L, p)}{\sum_p VAUTO(Det, L, p) + VTRUCK(Det, L, p) + VRV(Det, L, p)} \quad (16)$$

If detectors do not have a classification capability, representative hourly values are obtained by manual observations of CCTV images of detector sites.

Average vehicle length is obtained as follows:

$$AVL(Det,L,Hr)=AVAUTOLEN*(1-FRTRUCK(Det,L,Hr)-FRVRV(Det,L,Hr))+FRTRUCK(Det,L,Hr)*AVTRUCKLEN(Det,L,Hr)+FRVRV(Det,L,Hr)*AVRVLEN \quad (17)$$

Passenger car equivalents (PCE) are obtained as follows $$PCE(Det,L)=VOLFIL(Det,L)*((1-FRTRUCK(Det,L)-FRVRV(Det,L)+E_T*FRTRUCK(Det,L)+E_R*FRVRV(Det,L)) \quad (18)$$

6.2.4 Computation of Space-Mean-Speed and Density from Occupancy

Some traffic detector technologies do not measure speed at all or measure it poorly. Generally these technologies measure occupancy (the time period that the vehicle is in the detector's sensing zone). Speed and density for this class of detectors is obtained from volume and occupancy as follows.

Klein (Klein, L. A., "Sensor Technologies and Data Requirements for ITS", Artech House, 2001) provides the following relationship between density and occupancy.

$$DENFIL(Det,L)=(F*OCCFIL(Det,L))/(LL+AVL(DetL)) \quad (19)$$

where LL is the detector's sensing distance on the roadway and F is a coefficient. If AVL and LL are in feet, and F=5280, then DENFIL(Det,L) is in vehicles per mile per lane.

Rearranging the terms of Equation 9 provides the relationship for space-mean-speed for this case.

$$SPSP(Det,L)=VOLFIL(Det,L)/DENFIL(Det,L) \quad (20)$$

6.3 Convert Detector Data to the ALMA Data Structure

The data developed in Modules 6.1 [051] and 6.2 [051] are referenced to the coordinate system employed by the TMC developing the data. Since this is most likely different from the ALMA data [037], [038], [039] structure, conversion to the ALMA data structure is required. To do this, one and only one detector station is assigned to each ALMA zone. In some cases, the zone detector station might not physically lie within the zone 303. When the detector error indications show that the data is unacceptable, a value of −1 is assigned to the zone variable. Some detector types have the capability to classify vehicles according to length. Zone 303 based traffic variables are denoted by the ALMA data structure subscripts. These are B (barrel), Z (zone), L (lane).

6.4 Provide Zone Based Traffic Parameters to Vehicle

The roadways serviced by different traffic management centers 201 may be equipped with detectors using different technologies. The data parameters and their accuracy provided by these technologies differ depending on the technology. Table 3 identifies the traffic parameter data provided to the Guidance Assist Vehicle Module (GAVM) 205 as well as the associated computational process. A very broad set of possible algorithms and vehicle guidance rules may be implemented in the GAVM 205. The ALMAMC 202 data outputs described in this section provide the data required for this broad set.

TABLE 3

ALMAMC Traffic Data Outputs

| Traffic Parameter | Detectors with Accurate Volume and Occupancy Data | Detectors with Accurate Volume and Speed Data (may or May Not Include Accurate Occupancy Data) |
|---|---|---|
| Lane Volume (vehicles/hr) | VOLFIL (B, Z, L) - Kalman Filter output (Section 6.1) converted to ALMA data structure (Section 6.3) | VOLFIL (B, Z, L) - Kalman Filter output (Section 6.1) converted to ALMA data structure (Section 6.3) |
| Average Headway (hours/vehicle) | AHW (B, Z, L) = 1/ VOLFIL (B, Z, L) converted to ALMA data structure (Section 6.3) | = AHW (B, Z, L) = 1/ VOLFIL (B, Z, L) converted to ALMA data structure (Section 6.3) |
| Average Vehicle Length | AVL (B, L, Z) - Equation 17 converted to ALMA data structure (Section 6.3) | AVL (B, L, Z) - Equation 17 converted to ALMA data structure (Section 6.3) |
| Passenger Car Equivalent Volume | PCE (B, L, Z) - Equation 18 converted to ALMA data structure (Section 6.3) | PCE (B, L, Z) - Equation 18 converted to ALMA data structure (Section 6.3) |
| Lane Speed | SPSP (B, Z, L) - Equation 20 converted to ALMA data structure (Section 6.3) | SPSP (B, Z, L) - Equation 8 converted to ALMA data structure (Section 6.3) |
| Lane Density | DENFIL (B, Z, L) - Equation 19 converted to ALMA data structure (Section 6.3) | DENFIL (B, Z, L) - Equation 9 converted to ALMA data structure (Section 6.3) |

Module 7 1100—Miscellaneous Data

Table 4 identifies data that may vary and is therefore not included in the Static Database. It is basically obtained from the TMC, and transformed into ALMA coordinates as appropriate.

TABLE 4

Additional Data

| Symbol | Definition |
|---|---|
| BARNORM | Barrel incident status (0 if normal, 1 if abnormal) |
| EXC | Set of zones in barrel that access closed exit ramps |
| INCZONE | Set of closed lane(s) in this zone |
| LSTART | Dynamic lane index |

TABLE 4-continued

Additional Data

| Symbol | Definition |
|---|---|
| LVR | Lane vehicle requirements |
| ZEX | Set of closed entry zones in barrel |

Table 5 identifies certain parameters included in the static database.

TABLE 5

Parameters Included in Static Database

| Symbol | Definition |
|---|---|
| AUTOENF | Automatic enforcement of speed limit in barrel |
| LN | Number of lanes in barrel |
| LTYPE | Lane type |
| SSL | Static or default speed limit |
| TTL | Toll tag requirements for lane |
| VHL | Vehicle height limit |
| VWL | Vehicle weight limit |
| ZE | Entry zone in path |
| ZU | Number of zones in path |

APPENDIX A

ALMAMC Symbols

Refer to process descriptions for index referencing

AHW—Average headway

AUTOENF—Automatic enforcement of speed limit in barrel (T/F)

AVAUTOLEN—Average passenger car length

AVL—Average vehicle length

AVRVLEN—Average RV length

AVTRUCKLEN—Average truck length

B—Barrel number—a barrel is a homogeneous section of roadway (number and static or time of day use of lanes remains constant). Barrels may be separated by physical or functional separation. Barrel number must include a reference direction (N or E). E.g. E4
B1—Barrel entry point for toll
B2—Barrel exit point for toll
BARNORM—Barrel incident status (0 if normal, 1 if abnormal)
CB—Barrel with upstream incident
COMPFILOCC— Compensated filtered occupancy
CZ—Zone with upstream incident
D—Detector drop-out time—detector pick-up time
DB—Barrel with downstream incident
DBS—Downstream barrel on same roadway
DET—Detector ID as identified by TMC
DENFIL—Filtered density
DZ—Zone with downstream incident
DIR—Roadway direction
$E_R$—Equivalency factor for recreational vehicles
$E_T$—Equivalency factor for trucks
EXC—Set of zones in barrel that access closed exit ramps
F—Scaling coefficient
FRAUTO—Fractional value for automobiles
FRTRUCK—Fractional value for tucks
FRVRV—Fractional value for recreational vehicles
FB—First barrel in roadway
Hr—Hourly computation period
INC—Sets of closed barrels, lanes and zones
INCZONE—Set of closed lane(s) in this zone
L—Lane ID. Relative to reference direction for barrel even when major or complete flow is in opposite direction. Designate full left shoulder as L=0 (denote as X if shoulder doesn't exist, designate full right shoulder as RS if present. The leftmost normal travel lane is designated as L=1. With opposite flow lanes, add the designator R after the lane ID
LB—Last barrel in roadway
LCSAVTMC—LCS available and active in TMC coordinates (1 if available, 0 if not available)
LL—Detector sensing region length
LN—Number of lanes in barrel
LR—Occupancy compensation factor (ratio of effective length of vehicle plus loop to vehicle length)
LSS—Lane control command from ALMAMC
A—Straight permitted
D—Move to left
E—Move to right
F—Lane closed
J—No guidance provided
LSSTMC(TMC coordinates, L)—Lane control command from TMC (same commands as LSS)
LSTART—Dynamic lane index (0 indicates open running shoulder, 1 indicates restricted use)
LTYPE—Lane type (LTYPE=HOT for hot lanes else LTYPE=C)
LVR—Lane vehicle requirements. May be dynamic. Define as follows:
A—Passenger cars only
B—Buses only
C—Trucks only
D—No trucks
E—Buses and trucks only
F—No restrictions
N—Number of vehicles detected in time period T
NM—Name of roadway
NOOCC—Occupancy not available for this detector for this interval (normal=0, speed not available=1)
NOSPEED—Speed not available for this detector for this interval (normal=0, speed not available=1)
NOVOL—Volume not available for this detector for this interval (normal=0, speed not available=1)
OCCFIL—Filtered detector occupancy in TMC reference
OCCINT—Average detector occupancy for this interval
ON—Number of vehicle occupants required for HOV lane or toll free on HOT lane. This is provided in the static database as a function of time-of-day but may be varied. It is a set that identifies applicable barrels.
ONTMC—Number of vehicle occupants required for HOV lane or toll free on HOT lane in TMC coordinates.
p—Data accumulation period for vehicle counts
P—Path
PCE—Passenger car equivalents
PO—Position in TMC reference frame
R—File of set of downstream barrels on same roadway
SPDEV—Kalman Filter's indication of standard deviation for speed
SPFIL—Filtered detector speed data
SPMC—Zone speed from ALMAMC, −1 indicates that static speed limits may be used
SPINT—Average detector speed data from the TMC
SPSP—Space-mean-speed SSL—Static or default speed limit
SSL—Static speed limit
SZP(CB,CZ,DB,DZ)—Set of sequential zones with incidents present
TMCLC—Set of TMC lane closures in TMC coordinates
$t_i$—measured detector pulse presence—seconds
T—Specified time period
TTL—Toll tag requirement for lane (Y/N)
VAUTO—Passenger car volume
VC—Vehicle class
A—Passenger car
B—Bus
C—Truck
VHL—Vehicle height limit
VOLFIL—Filtered detector volume in TMC reference
VOLINT—Average detector volume for this interval
VRV—Recreational vehicle volume
VSLSTMC—Variable speed limit from TMC
VTR—Set of toll charges from vehicle entry zone to vehicle exit zone
VTRTMC—Set of toll charges from vehicle entry zone to vehicle exit zone in TMC coordinates
VTRUCK—Truck volume
VWL—Vehicle weight limit
Z—Zone
Z1—Zone entry point for toll
Z2—Zone exit point for toll
ZE—Entry zone to path
ZEX—Set of closed entry zones in barrel
ZP—Zone path (set)
ZU—Number of zones in path
θ—Raw detector occupancy data

What is claimed is:

1. A method of assisting in selection of driving lanes and target speeds for vehicles, comprising the steps of:

a. receiving unprocessed lane-specific limited-access highway data from a traffic management center (TMC);

b. combining the unprocessed lane-specific limited-access highway data with data from a static database to create intermediate lane-specific limited-access highway data;

c. generating processed lane-specific limited-access highway data from the intermediate lane-specific limited-access highway data, said processed lane-specific limited-access highway data conforming to a data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway; and d. providing the processed lane-specific limited-access highway data to one or more vehicles, said processed lane-specific limited-access highway data enabling an in-vehicle guidance assist vehicle module of the one or more vehicles to select a preferred lane and target speed for the preferred lane using a copy or a subset of the static database.

2. The method of claim 1, wherein the step of providing the processed lane-specific limited-access highway data to the one or more vehicles is dynamic.

3. The method of claim 1, wherein the in-vehicle guidance assist vehicle module uses the processed lane-specific limited-access highway data to develop lane selection and target speed selection.

4. The method of claim 1, wherein the processed lane-specific limited-access highway data provided to the in-vehicle guidance assist vehicle module includes one or more of lane volume, lane passenger car equivalent volume, lane average headway, lane density, lane speed, vehicle length by lane, static and dynamic regulatory lane-use data.

5. The method of claim 1, wherein appropriate information decision zones relating to roadway geometries and roadway traffic information devices are established, and wherein the processed lane-specific limited-access highway data corresponding to the information decision zones is provided to the one or more vehicles sufficiently in advance of an action required by the one or more vehicles or a vehicle operator of the one or more vehicles to facilitate safe lane changes and speed adjustments in conformance with individual motorist driving preferences.

6. The method of claim 1, further comprising using the processed lane-specific limited-accessed highway data in conjunction with software in the one or more vehicles.

7. The method of claim 1, further comprising using the processed lane-specific limited-accessed highway data in conjunction with data provided by the one or more vehicles.

8. The method of claim 1, further comprising using the processed lane-specific limited-accessed highway data in conjunction with data provided by an occupant of the one or more vehicles.

9. The method of claim 8, wherein the data provided by the occupant of the one or more vehicles includes one or more of vehicle characteristics, vehicle passenger occupancy, highway use preferences, and toll preferences.

10. The method of claim 1, further comprising periodically providing the data from the static database according to the roadway zone based data structures to the one or more vehicles to update the copy or the subset of the static database in the one or more vehicles.

11. The method of claim 1, wherein the unprocessed lane-specific limited-access highway data includes one or more of lane based traffic parameter data, TMC traffic incident report data, lane blockage information, lane closure information, limitations on lane use, shoulder information, regulatory lane use data, scheduled roadway closures, dynamic speed limits, current lane speed, volume and occupancy vehicle detector data, camera data, vehicle class based lane restrictions, vehicle overheight restrictions, vehicle overweight restrictions, vehicle occupant requirements, and toll information to assist in the generation of lane selection information and the target speed information for vehicles.

12. The method of claim 1, wherein the processed lane-specific limited-access highway data is generated based on one or more factors selected from the group consisting of traffic information, limitations on lane use, shoulder information, regulatory lane use data, scheduled roadway closures, toll information, dynamic speed limits, current lane speed, volume and occupancy vehicle detector data, camera data, vehicle class, vehicle overheight restrictions, vehicle overweight restrictions, vehicle occupant calls, and toll information.

13. A non-transitory computer-implemented roadway zone based data structure for expressing traffic parameters, incident data, regulatory data and toll information in geographical segments that are appropriate for limited-access highway lane selection and target speed selection for the chosen lanes, said data structure comprising:

a. at least one interface for receiving unprocessed lane-specific limited-access highway data from a traffic management center; and b. a processor coupled to the at least one interface, wherein the processor receives the unprocessed lane-specific limited-access highway data through the at least one interface, processes the unprocessed lane-specific limited-access highway data, generates processed lane-specific limited-access highway data conforming to a data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway and transmits processed lane-specific limited-access highway data to at least one vehicle in a form appropriate for limited-access highway lane selection and target speed selection for the chosen lanes.

14. The data structure of claim 13, further comprising a computer storage for storing processed lane-specific limited-access highway data, wherein the processor receives the unprocessed lane-specific limited-access highway data through the at least one interface, processes the unprocessed lane-specific limited-access highway data, and outputs processed lane-specific limited-access highway data to the computer storage in a form appropriate for limited-access highway lane selection and target speed selection for the chosen lanes.

15. The data structure of claim 14, wherein the processed lane-specific limited-access highway data is transmitted to the at least one vehicle from the computer storage.

16. A system for assisting in selection of driving lanes and target speeds for vehicles, comprising:

a. an interface for receiving unprocessed lane-specific limited-access highway data from a traffic management center;

b. a processor coupled to the interface, wherein the processor receives the unprocessed lane-specific limited-access highway data through the interface, processes the unprocessed lane-specific limited-access highway data, generates processed lane-specific limited-access highway data conforming to a data structure comprising barrels divided into zones, wherein boundaries of the barrels are defined by physical roadway configuration changes and permanent changes in regulatory use of the limited-access highway lanes and wherein boundaries of the zones are defined by changes in traffic conditions along the limited-access highway resulting from entry ramps and exit ramps and locations of motorist information devices and regulatory devices that provide changeable information and active traffic management control of the limited-access highway, and transmits processed lane-specific limited-access highway data to one or more vehicles; and c. one or more of a lane closure guidance module, lane and speed limit requirements module, dynamic lane use requirements module, toll information module, module for checking detector values for accuracy, module for formatting traffic data, miscellaneous data module, and static database module, said one or more module operatively coupled to the processor for developing driving lane and target speed selection.

17. A system of claim 16, further comprising a computer storage for storing the processed lane-specific limited-access highway data, said computer storage being coupled to the processor, wherein the processor receives the unprocessed lane-specific limited-access highway data through the interface, processes the unprocessed lane-specific limited-access highway data, and outputs the processed lane-specific limited-access highway data to the computer storage.

18. A system of claim 17, further comprising a transmitter operatively coupled to the computer storage for transmitting the processed lane-specific limited-access highway data to the one or more vehicles.

* * * * *